United States Patent [19]

Vasile

[11] 4,296,486

[45] Oct. 20, 1981

[54] SHIELDED ELECTROMAGNETIC ACOUSTIC TRANSDUCERS

[75] Inventor: Carmine F. Vasile, Huntington, N.Y.

[73] Assignee: Rockwell International Corporation, El Segundo, Calif.

[21] Appl. No.: 114,862

[22] Filed: Jan. 24, 1980

[51] Int. Cl.[3] ..... H04R 15/00

[52] U.S. Cl. ..... 367/140; 367/168; 73/643; 310/26

[58] Field of Search ..... 367/140, 156, 168; 73/643; 310/26

[56] References Cited

U.S. PATENT DOCUMENTS

| | | | |
|---|---|---|---|
| 3,850,028 | 11/1974 | Thompson et al. | 73/71.5 US |
| 3,963,980 | 6/1976 | Shkarlet | 73/643 |
| 4,048,847 | 9/1977 | Alers et al. | 73/67.5 R |
| 4,080,836 | 3/1978 | Thompson et al. | 73/597 |
| 4,092,868 | 6/1978 | Thompson et al. | 73/638 |
| 4,104,922 | 8/1978 | Alers et al. | 73/643 |
| 4,127,035 | 11/1978 | Vasile | 73/629 |

*Primary Examiner*—Theodore M. Blum

*Attorney, Agent, or Firm*—H. Fredrick Hamann; Craig O. Malin; John J. Deinken

[57] ABSTRACT

Disclosed is an electromagnetic acoustic transducer, including a source of magnetic flux for establishing a static magnetic field, an electrical conductor for conducting an alternating current in the static magnetic field, and an electrically conductive, nonmagnetic shield disposed between the source of magnetic flux and the conductor.

13 Claims, 4 Drawing Figures

SHIELDED ELECTROMAGNETIC ACOUSTIC TRANSDUCERS

BACKGROUND OF THE INVENTION

This invention relates to the field of ultrasonics and, more particularly, to ultrasonic transducers for generating and detecting acoustic wave energy.

Ultrasonic techniques have become increasingly important in recent years in many different applications. In materials science, for example, evaluation procedures utilizing ultrasonics have been advantageously employed in nondestructive testing.

In order to utilize ultrasonic energy to interrogate a material, some means must be employed to generate ultrasonic waves within the material. In the past, ultrasonic transducers which operated by virtue of the piezoelectric principle have been used. More recently, however, new ultrasonic transducer designs have been developed with improved performance and increased flexibility of operation. These new transducers, known as electromagnetic acoustic transducers (EMATs), are more versatile than prior art designs because they need not be maintained in physical contact with an object to generate an ultrasonic wave therein. Furthermore, EMATs are capable of operating at high speeds and in adverse environments, such as high temperature.

The EMAT designs which are known in the art, however, exhibit some disadvantages in operation as compared to other transducer types. EMATs tend to exhibit relatively high electrical losses and high electrical impedance, as compared to prior art transducers, properties which may make it more difficult in some applications to generate an ultrasonic signal of sufficient amplitude with this type of transducer.

Therefore, a need has developed in the art for an improved electromagnetic acoustic transducer which operates with lower electrical losses and exhibits a relatively low electrical impedance.

SUMMARY OF THE INVENTION

It is a general object of this invention to provide a new and improved electromagnetic acoustic transduction technique.

An electromagnetic acoustic transducer, according to the invention, includes a source of magnetic flux for establishing a static magnetic field, an electrical conductor for conducting an alternating current in the static magnetic field, and an electrically conductive, nonmagnetic shield disposed between the source of magnetic flux and the conductor. In the preferred embodiment, the shield is provided in the form of a thin metallic sheet in contact with the source of magnetic flux and spaced from the conductor.

In a first more particular embodiment, the source of magnetic flux further includes a row of alternately oriented permanent magnets.

In a second more particular embodiment, the source of magnetic flux further includes an electromagnet.

A method for generating an ultrasonic wave in an electrically conductive object, according to the present invention, includes the steps of:

(a) positioning a source of magnetic flux to establish a static magnetic field near a surface of the object, (b) positioning an electrical conductor within the static magnetic field, (c) positioning an electrically conductive, nonmagnetic shield between the source of magnetic flux and the conductor, and (d) connecting the conductor to an alternating current source.

A method for detecting an ultrasonic wave in an electrically conductive object, according to the present invention, includes the steps of:

(a) positioning a source of magnetic flux to establish a static magnetic field near a surface of the object, (b) positioning an electrical conductor within the static magnetic field, (c) positioning an electrically conductive, nonmagnetic shield between the source of magnetic flux and the conductor, and (d) detecting the signal induced in the conductor by the ultrasonic wave.

Examples of the more important features of the invention have been broadly outlined in this Summary in order to facilitate an understanding of the detailed description that follows and so that the contributions which the invention provides to the art may be better appreciated. There are, of course, additional features of the invention, which will be further described below and which are included within the subject matter of the appended claims.

BRIEF DESCRIPTION OF THE DRAWINGS

Additional objects, features, and advantages of the present invention will become apparent by referring to the detailed description below of the preferred embodiments in connection with the accompanying drawings, wherein like reference numerals refer to like elements throughout all the figures. In the drawings.

DESCRIPTION OF THE PREFERRED EMBODIMENT

Figure 1:
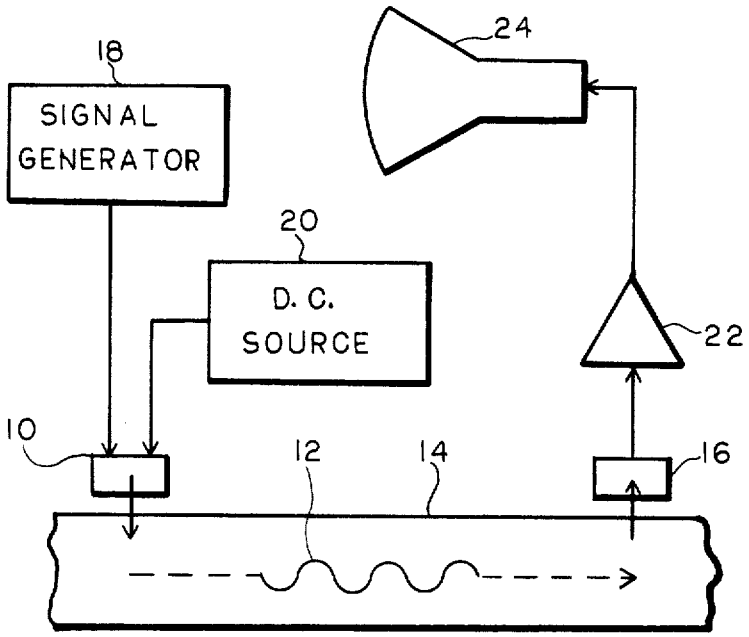
FIG. 1 is an electrical schematic diagram illustrating a typical arrangement for utilizing electromagnetic acoustic transducers to generate and detect ultrasonic waves in an object.

Electromagnetic acoustic transducers (EMATs) may be employed for generating an ultrasonic wave in a material as well as detecting such a wave. FIG. 1 is an electrical schematic which illustrates one possible circuit configuration for utilizing electromagnetic acoustic transducers in this manner. In FIG. 1, a transmitting electromagnetic acoustic transducer 10 is adapted to generate an ultrasonic wave 12 in an electrically conductive object 14, while a receiving EMAT 16 is employed to detect the presence of the wave 12 in the material. A signal generator 18 is provided to supply the EMAT 10 with a high frequency signal at an appropriate frequency to generate an ultrasonic wave 12 having the desired wavelength. A source of direct current 20 may also be necessary to supply the electromagnet of the EMAT 10, if the transducer is equipped with such an electromagnet. The signal generated by the receiving transducer 16 in response to the ultrasonic wave 12 is supplied to an amplifier 22, where the signal is boosted and routed to a suitable display, such as an oscilloscope 24.

The operation of an electromagnetic acoustic transducer is based on the physical principles which govern the operation of a common electrical motor. In an EMAT, a magnet is used to provide a static magnetic field. An electrical conductor is placed in the static field and is driven by a high frequency signal. The electromagnetic field created by the alternating current induces eddy currents in an electrically conductive material placed near the transducer. The interaction between these eddy currents and the static magnetic field then produces a Lorentz force which causes an ultrasonic wave to be generated in the material. An electromagnetic acoustic transducer can also be used to detect an ultrasonic wave, as mentioned above, by a reciprocal process. In addition, if the material in which the wave is to be generated is ferromagnetic, magnetostrictive forces may also contribute to the ultrasonic wave generation. Representative designs of electromagnetic acoustic transducers, for example, are disclosed in U.S. Pat. Nos. 3,850,028; 4,048,847; and 4,127,035, the teachings of which are incorporated herein by reference.

Although the introduction of electromagnetic acoustic transducers improved in many ways the available techniques for generating ultrasonic waves, the EMATs heretofore known in the art have exhibited some undesirable characteristics. The coil of an EMAT, for example, tends to induce eddy currents in the associated magnet, and the higher impedance exhibited by known EMAT designs, as compared to other types of transducers, tends to make such transducers more difficult to drive by electronic circuitry. It is an outstanding feature of this invention to provide an improved electromagnetic acoustic transducer which is equipped with shielding to reduce these undesirable characteristics.

Figure 2:
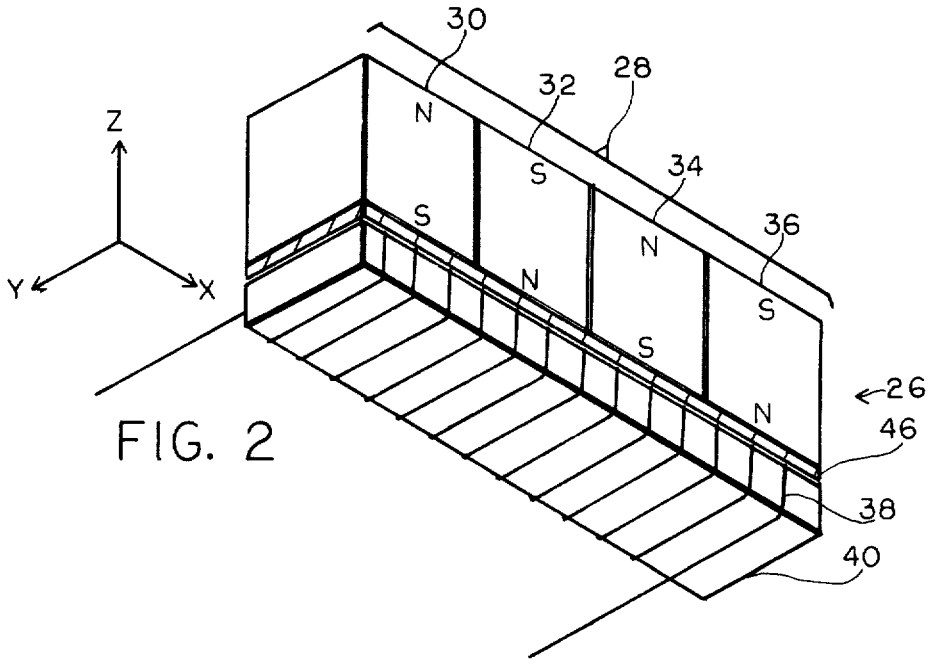
FIG. 2 is an isometric view of a periodic magnet electromagnetic acoustic transducer constructed according to the present invention and designed to generate Lamb waves.
Figure 3:
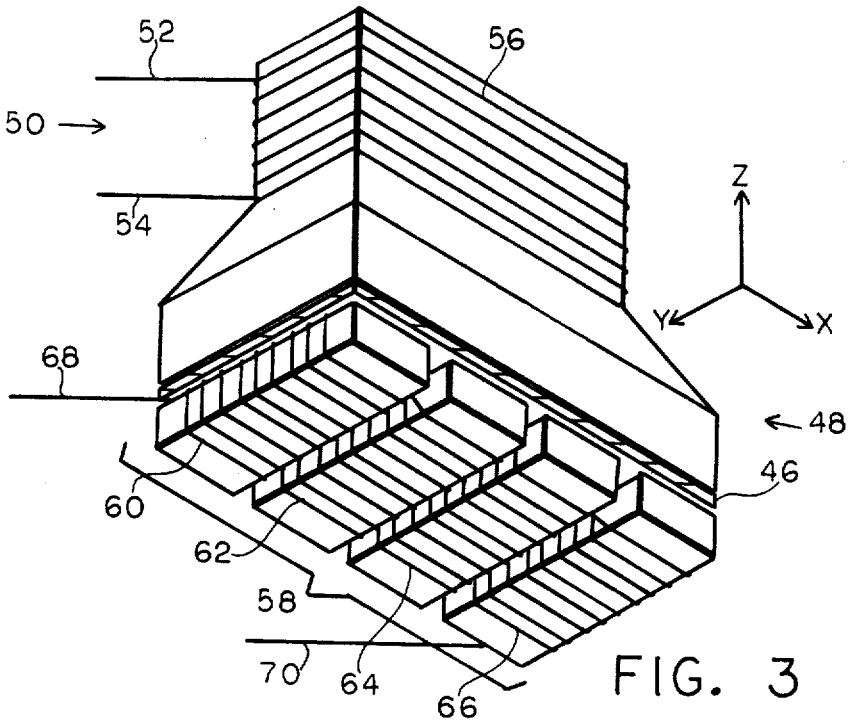
FIG. 3 is an isometric view of an electromagnetic acoustic transducer designed to generate horizontally polarized shear waves.
Figure 4:
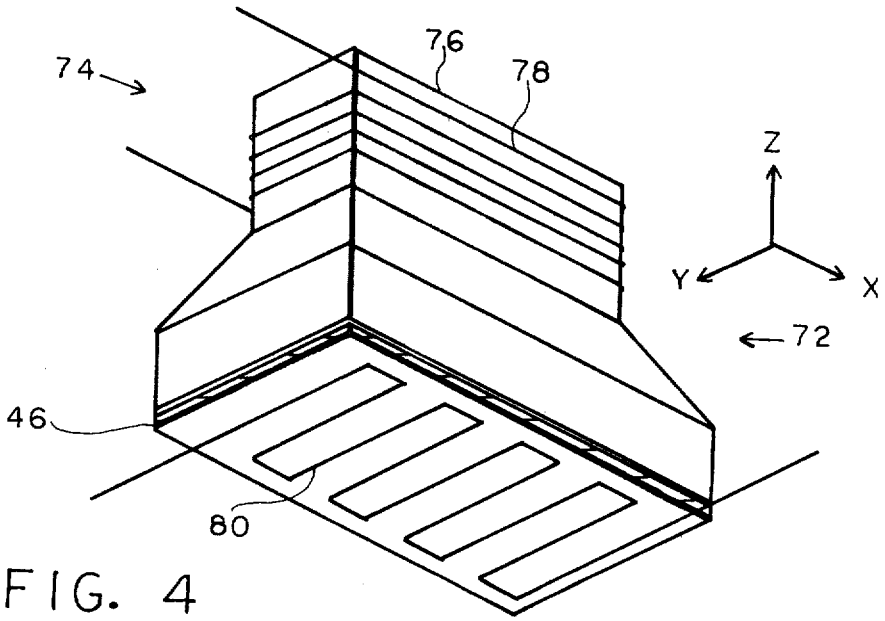
FIG. 4 is an isometric view of an electromagnetic acoustic transducer employing a meander coil conductor.

FIGS. 2–4 provide several representative examples of different electromagnetic acoustic transducers equipped with the shielding of the present invention. Those skilled in the art will appreciate that these examples are not inclusive and that the invention is applicable as well to other EMAT configurations.

In FIG. 2, an isometric view is provided illustrating a shielded periodic magnet electromagnetic acoustic transducer 26 for generating ultrasonic Lamb waves. In the EMAT 26, a row 28 of permanent magnets provides a static magnetic field which is oriented in the z direction so that the field will be normal to the surface of a conductive material in which an ultrasonic wave is to be generated. The row 28 is composed of a number of alternately oriented permanent magnets 30, 32, 34, and 36. With this configuration, it will be appreciated that a static magnetic field is created which is spatially periodic in intensity, with the period of the field equal to twice the width of one of the uniformly sized magnets.

A flattened helical coil 38 is wound on an insulating form 40 in the transverse direction, i.e., the axis of the coil 38 is oriented along the x axis and perpendicular to the z-directed static magnetic field. With this configuration, the EMAT 26 will generate ultrasonic Lamb waves which travel in the x direction when a high frequency signal, at a frequency appropriate for the period of the transducer, is applied to the terminals 42 and 44 of the coil 38. The transducer may also be used to detect a Lamb wave which is traveling in the x direction, since such a wave will cause an alternating current to be generated in the coil 38.

According to an outstanding feature of this invention, a highly conductive, nonmagnetic shield 46, made of a suitable material, such as copper, is positioned between the row 28 and the coil 38. The shield 46 is placed so that it contacts the magnets 30–36 and is only slightly spaced from the coil 38. In this configuration, the shield acts as a ground plane and reduces losses associated with the eddy currents which are induced in the magnets by the coil 38. The shield also helps to reduce the impedance level of the EMAT 26. The shield accomplishes these desirable improvements in the performance parameters of the EMAT while causing only a minimal loss in the magnetic field strength.

Now referring to FIG. 3, a second embodiment of the present invention is shown in an isometric view of a shielded electromagnetic acoustic transducer 48. In FIG. 3, an electromagnet 50 is oriented to produce a static magnetic field in the z direction upon the application of a current to the terminals 52 and 54 of the magnet coil 56. The current applied to the electromagnet 50 may be varied, making this embodiment particularly suited to overcome problems associated with magnetostrictive variations due to particular alloy variations among the materials in which an ultrasonic wave is to be generated. A row 58 of flattened helical coils 60, 62, 64, and 66 is uniformly spaced and positioned so that the axes of the coils define a coil plane which is normal to the static magnetic field. The parallel coils are wound in alternating directions and are connected in series, so that an alternating current, when applied to the terminals 68 and 70 of the row, will produce at any instant in time a magnetic field which varies periodically in the y direction. With the configuration shown for the EMAT 48, horizontally polarized shear waves will be produced which propagate in the x direction. The transducer may also be reciprocally used to detect similarly oriented horizontally polarized shear waves.

A shield 46, similar to that shown in FIG. 2, is positioned between the electromagnet 50 and the row 58 of the transducer. The shield operates in this transducer in the same manner discussed above with respect to FIG. 2 to provide improved operating characteristics for the transducer 48.

A third embodiment of the present invention is illustrated in FIG. 4, which is an isometric view of a meander coil transducer 72. In this transducer, a source of magnetic flux is provided by an electromagnet 74, including a core 76 and a magnet coil 78 for connection to a DC source. An electrical conductor is provided in the form of a meander coil 80, positioned to conduct an alternating current in a serpentine fashion through the static magnetic field established by the electromagnet 74. As in the transducers illustrated in FIGS. 2 and 3, an electrically conductive, nonmagnetic shield 46 is disposed between the electromagnet 74 and the meander coil 80. In the preferred embodiment illustrated, the shield is a thin copper sheet in contact with the electromagnet and slightly spaced from the meander coil.

In conclusion, although typical embodiments of the present invention have been illustrated and discussed herein, numerous modifications and alternative embodiments of the apparatus and method of this invention will be apparent to those skilled in the art in view of this description. Accordingly, this description is to be considered as illustrative only and is provided for the purpose of teaching those skilled in the art the manner of constructing the apparatus and performing the method of this invention. Furthermore, it should be understood that the forms of the invention depicted and described herein are to be considered as the presently preferred embodiments. Various changes may be made in the configurations, sizes, and arrangements of the components of the invention, as will be recognized by those skilled in the art, without departing from the scope of the invention. Equivalent elements, for example, might be substituted for those illustrated and described herein, parts or connections might be reversed or otherwise interchanged, and certain features of the invention might be utilized independently of the use of other features, all as will be apparent to one skilled in the art after receiving the benefit obtained through reading the above description of the invention.

What is claimed is:

1. An electromagnetic acoustic transducer for use near a surface of an electrically conductive object, comprising:

a source of magnetic flux for establishing a static magnetic field in said object;

an electrical conductor disposed between said source of magnetic flux and said surface and proximate to said surface for conducting an alternating current in said static magnetic field; and a thin, electrically conductive, nonmagnetic shield disposed between said source of magnetic flux and said conductor.

2. The transducer of claim 1, wherein said shield comprises a thin metallic sheet.

3. The transducer of claim 2, wherein said shield further comprises a copper sheet.

4. The transducer of claim 3, wherein said shield is disposed in contact with said source of magnetic flux and spaced from said conductor.

5. The transducer of claim 1, wherein said source of magnetic flux further comprises a row of alternately oriented permanent magnets.

6. The transducer of claim 1, wherein said source of magnetic flux further comprises an electromagnet.

7. An electromagnetic acoustic transducer for use near a surface of an electrically conductive object, comprising:

a row of alternately oriented permanent magnets for establishing a static magnetic field in said object;

an electrical conductor disposed between said row of magnets and said surface and proximate to said surface for conducting an alternating current in said static magnetic field; and a thin metallic shield disposed between said row of magnets and said conductor such that said shield contacts said row of magnets and is spaced slightly from said conductor.

8. An electromagnetic acoustic transducer for use near a surface of an electrically conductive object, comprising:

an electromagnet for establishing a static magnetic field in said object;

an electrical conductor disposed between said electromagnet and said surface and proximate to said surface for conducting an alternating current in said static magnetic field; and a thin metallic shield disposed between said electromagnet and said conductor such that said shield contacts said electromagnet and is spaced slightly from said conductor.

9. An improved electromagnetic acoustic transducer for use near a surface of an electrically conductive object, including a source of magnetic flux for establishing a static magnetic field in said object and an electrical conductor disposed between said source of magnetic flux and said surface and proximate to said surface for conducting an alternating current in said static magnetic field, wherein the improvement comprises a thin, electrically conductive, nonmagnetic shield disposed between said source of magnetic flux and said conductor.

10. The transducer of claim 9, wherein said shield further comprises a thin metallic sheet.

11. An electromagnetic acoustic transducer for use near a surface of an electrically conductive object, comprising:

means for establishing a static magnetic field in said object;

means disposed between said magnetic field means and said surface and proximate to said surface for conducting an alternating current through said magnetic field; and a thin, electrically conductive, nonmagnetic shield disposed between said static magnetic field means and said conducting means.

12. An improved method for generating an ultrasonic wave in an electrically conductive object, including the steps of positioning a source of magnetic flux to establish a static magnetic field in the object, positioning an electrical conductor between the source of magnetic flux and the surface and proximate to the surface, and connecting the conductor to an alternating current source, wherein the improvement comprises the step of positioning a thin, electrically conductive, nonmagnetic shield between the source of magnetic flux and the conductor.

13. An improved method for detecting an ultrasonic wave in an electrically conductive object, including the steps of positioning a source of magnetic flux to establish a static magnetic field in the object, positioning an electrical conductor between the source of magnetic flux and the surface and proximate to the surface, and detecting the signal induced in the conductor by the ultrasonic wave, wherein the improvement comprises the step of positioning a thin, electrically conductive, nonmagnetic shield between the source of magnetic flux and the conductor.

* * * * *